US006244840B1

(12) United States Patent
Takeuchi et al.

(10) Patent No.: US 6,244,840 B1
(45) Date of Patent: Jun. 12, 2001

(54) SCROLL COMPRESSOR HAVING END PLATES OF FIXED AND REVOLVING SCROLLS THICKER THAN HEIGHTS OF SPIRAL PROTRUSIONS OF THE SCROLLS

(75) Inventors: Makoto Takeuchi; Takahide Itoh, both of Nagoya; Shigeki Miura, Nishi-kasugai-gun, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/589,172

(22) Filed: Jun. 8, 2000

(30) Foreign Application Priority Data

Jun. 8, 1999 (JP) ..... 11-161689

(51) Int. Cl.[7] ..... F03C 2/00
(52) U.S. Cl. ..... 418/55.2; 418/55.1
(58) Field of Search ..... 418/55.2, 55.1

(56) References Cited

U.S. PATENT DOCUMENTS

| | | | | |
|---|---|---|---|---|
| 4,464,100 | * | 8/1984 | Machida et al. | 418/55.1 |
| 4,579,512 | * | 4/1986 | Shiibayashi et al. | 418/55.1 |
| 4,774,816 | * | 10/1988 | Uchikawa et al. | 418/55.1 |
| 5,127,809 | * | 7/1992 | Amata et al. | 418/55.2 |
| 5,142,885 | * | 9/1992 | Utter et al. | 418/55.1 |
| 5,533,887 | | 7/1996 | Maruyama et al. . | |
| 5,667,370 | | 9/1997 | Im . | |

FOREIGN PATENT DOCUMENTS

| | | | | |
|---|---|---|---|---|
| 58-222901 A1 | * | 12/1983 | (JP) | 418/55.2 |
| 60-233388 A1 | * | 11/1985 | (JP) | 418/55.2 |
| 4-121483 A1 | * | 4/1992 | (JP) | 418/55.2 |
| 5-164067 A1 | * | 6/1993 | (JP) | 418/55.2 |
| 6-317269 | | 11/1994 | (JP) . | |
| 7-018602 | | 3/1995 | (JP) . | |
| WO 90/07683 | | 7/1990 | (WO) . | |

OTHER PUBLICATIONS

U.S. Ser. No. 09/589,172, filed Jun. 8, 2000, Status Pending.
U.S. Ser. No. 09/588,573, filed Jun. 7, 2000, Status Pending.
U.S. Ser. No. 09/588,707, filed Jun. 7, 2000, Status Pending.
U.S. Ser. No. 09/588776, filed Jun. 7, 2000, Status Pending.
U.S. Ser. No. 09/588,731, filed Jun. 7, 2000, Status Pending.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor with which there is no leakage of the working gas from the compression chamber is disclosed, in which deformation of each end plate of the fixed scroll and revolving scroll is prevented. The scroll compressor comprises a casing; a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber. In the structure, a working gas introduced in the casing is compressed in the compression chamber and then discharged according to the revolving operation of the revolving scroll; and given thickness $T_1$ of the end plate of the fixed scroll, thickness $T_2$ of the end plate of the revolving scroll, height $H_1$ of the spiral protrusion of the fixed scroll, and height $H_2$ of the spiral protrusion of the revolving scroll, the following condition is satisfied: $T_1>0.9H_1$, and $T_2>0.9H_2$.

6 Claims, 5 Drawing Sheets

SCROLL COMPRESSOR HAVING END PLATES OF FIXED AND REVOLVING SCROLLS THICKER THAN HEIGHTS OF SPIRAL PROTRUSIONS OF THE SCROLLS

BACKGROUND OF THE INVENTION

1. Field of the Invention

The present invention relates to a scroll compressor, in particular, one suitable for operation in a vapour-compression refrigerating cycle which uses a refrigerant, such as $CO_2$, in a supercritical area thereof.

2. Description of the Related Art

A conventional scroll compressor generally comprises a casing; a fixed scroll and a revolving scroll in the housing, each scroll comprising an end plate and a spiral protrusion built on an inner surface of the end plate, said inner surface facing the other end plate so as to engage the protrusions of each scroll and form a spiral compression chamber. In this structure, the introduced working gas is compressed in the compression chamber and then discharged according to the revolving operation of the revolving scroll. In order to secure enough (large) space for the compression chamber, the height of each spiral protrusion of the fixed scroll and revolving scroll is larger than the height of each end plate.

As for the vapour-compression refrigerating cycle, one of the recently proposed measures to avoid the use of Freon (fron, a refrigerant) in order to protect the environment is the use of a refrigerating cycle using $CO_2$ as the working gas (i.e., the refrigerant gas). This cycle is called "$CO_2$ cycle" below. An example thereof is disclosed in Japanese Examined Patent Application, Second Publication, No. Hei 7-18602. The operation of this $CO_2$ cycle is similar to the operation of a conventional vapour-compression refrigerating cycle using Freon. That is, as shown by the cycle A →B→C→D→A in FIG. 5 (which shows a $CO_2$ Mollier chart), $CO_2$ in the gas phase is compressed using a compressor (A→B), and this hot and compressed $CO_2$ in the gas phase is cooled using a gas cooler (B→C). This cooled gas is further decompressed using a decompressor (C→D), and $CO_2$ in the gas-liquid phase is then vaporized (D→A), so that latent heat with respect to the evaporation is taken from an external fluid such as air, thereby cooling the external fluid.

The critical temperature of $CO_2$ is approximately 31° C., that is, lower than that of Freon, the conventional refrigerant. Therefore, when the temperature of the outside air is high in the summer season or the like, the temperature of $CO_2$ at the gas cooler side is higher than the critical temperature of $CO_2$. Therefore, in this case, $CO_2$ is not condensed at the outlet side of the gas cooler (that is, line segment B-C in FIG. 3 does not intersect with the saturated liquid curve SL). In addition, the condition at the outlet side of the gas cooler (corresponding to point C in FIG. 3) depends on the discharge pressure of the compressor and the $CO_2$ temperature at the outlet side of the gas cooler, and this $CO_2$ temperature at the outlet side depends on the discharge ability of the gas cooler and the outside temperature (which cannot be controlled). Therefore, substantially, the $CO_2$ temperature at the outlet side of the gas cooler cannot be controlled. Accordingly, the condition at the outlet side of the gas cooler (i.e., point C) can be controlled by controlling the discharge pressure of the compressor (i.e., the pressure at the outlet side of the gas cooler). That is, in order to keep sufficient cooling ability (i.e., enthalpy difference) when the temperature of the outside air is high in the summer season or the like, higher pressure at the outlet side of the gas cooler is necessary as shown in the cycle E→F→G→H→E in FIG. 3. In order to satisfy this condition, the operating pressure of the compressor must be higher in comparison with the conventional refrigerating cycle using Freon. In an example of an air conditioner used in a vehicle, the operating pressure of the compressor is 3 kg/cm$^2$ in case of using R134 (i.e., conventional Freon), but 40 kg/cm$^2$ in case of $CO_2$. In addition, the operation stopping pressure of the compressor of this example is 15 kg/cm$^2$ in case of using RI 34, but 100 kg/cm$^2$ in case of $CO_2$.

In such a scroll compressor using $CO_2$ as the working gas and having high operating pressure, if the thickness of each end plate of the fixed scroll and revolving scroll is smaller than the height of each spiral protrusion of the fixed and revolving scrolls, each end plate tends to bend and be deformed due to a load generated in the compression operation, so that the sealing ability of the compression chamber is degraded. As a result, the (amount of) discharge may be decreased due to the leakage of the working gas from the compression chamber, or the temperature of the discharge gas may rise due to recompression of the leaked gas, so that degradation of the performance of the compressor is inevitable.

SUMMARY OF THE INVENTION

In consideration of the above circumstances, an objective of the present invention is to provide a scroll compressor with which there is no leakage of the working gas from the compression chamber, in which deformation of each end plate of the fixed scroll and revolving scroll is prevented.

Therefore, the present invention provides a scroll compressor comprising:

a casing;

a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber, wherein:

a working gas introduced in the casing is compressed in the compression chamber and then discharged according to the revolving operation of the revolving scroll; and given thickness $T_1$ of the end plate of the fixed scroll, thickness $T_2$ of the end plate of the revolving scroll, height $H_1$ of the spiral protrusion of the fixed scroll, and height $H_2$ of the spiral protrusion of the revolving scroll, the following condition is satisfied:

$$T_1>0.9H_1$$

$$T_2>0.9H_2$$

According to the above scroll compressor, even in a scroll compressor having a considerably high operating pressure, the end plates of the fixed scroll and revolving scroll are not easily deformed when the end plates receive a load generated in the compression operation, and thus the sealing ability of compression chamber is not degraded. As a result, the (amount of) discharge is not decreased due to the leakage of the working gas from the compression chamber, and the temperature of the discharge gas does not rise due to recompression of the leaked gas, so that the performance of the compressor is improved.

Preferably, ribs for reinforcing the fixed scroll and the revolving scroll are respectively provided at the back face side of each scroll. Accordingly, even if the thickness of the end plate is smaller than the height of the spiral protrusion, that is, smaller than an originally defined size, rigidity equivalent to that obtained by the structure having the originally defined size can be obtained. Therefore, the performance of the compressor can be further improved.

Preferably, the working gas is carbon dioxide. In this case, the present invention can be effectively applied to a scroll compressor which uses a refrigerating cycle using $CO_2$ as the working gas, and which has a high operating pressure.

BRIEF DESCRIPTION OF THE DRAWINGS

FIG. 2A is a plan view of the revolving scroll, and FIG. 2B is a view observed from the lower side of the structure as shown in FIG. 2A. FIG. 2C is a plan view of the revolving scroll, and FIG. 2D is a view observed from the lower side of the structure as shown in FIG. 2C.

DESCRIPTION OF THE PREFERRED EMBODIMENTS

Hereinafter, an embodiment of the scroll compressor according to the present invention will be explained with reference to the drawings.

Figure 4:
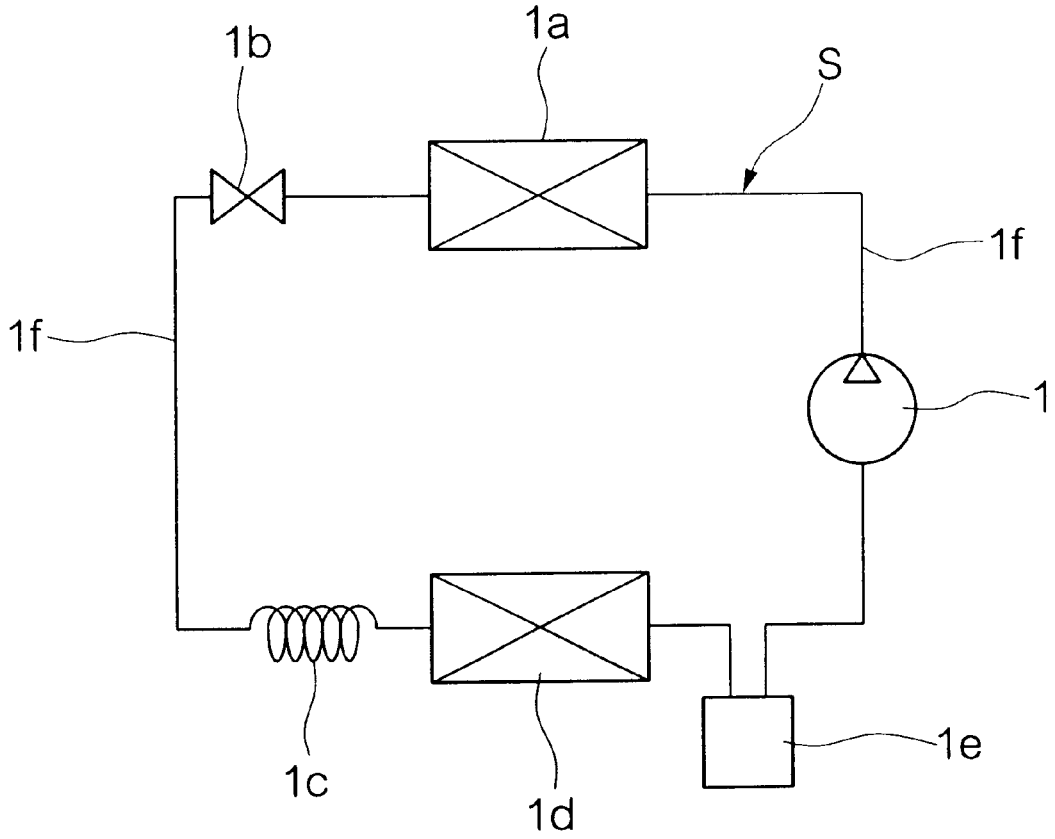
FIG. 4 is a diagram showing a vapour-compression refrigerating cycle.
Figure 5:
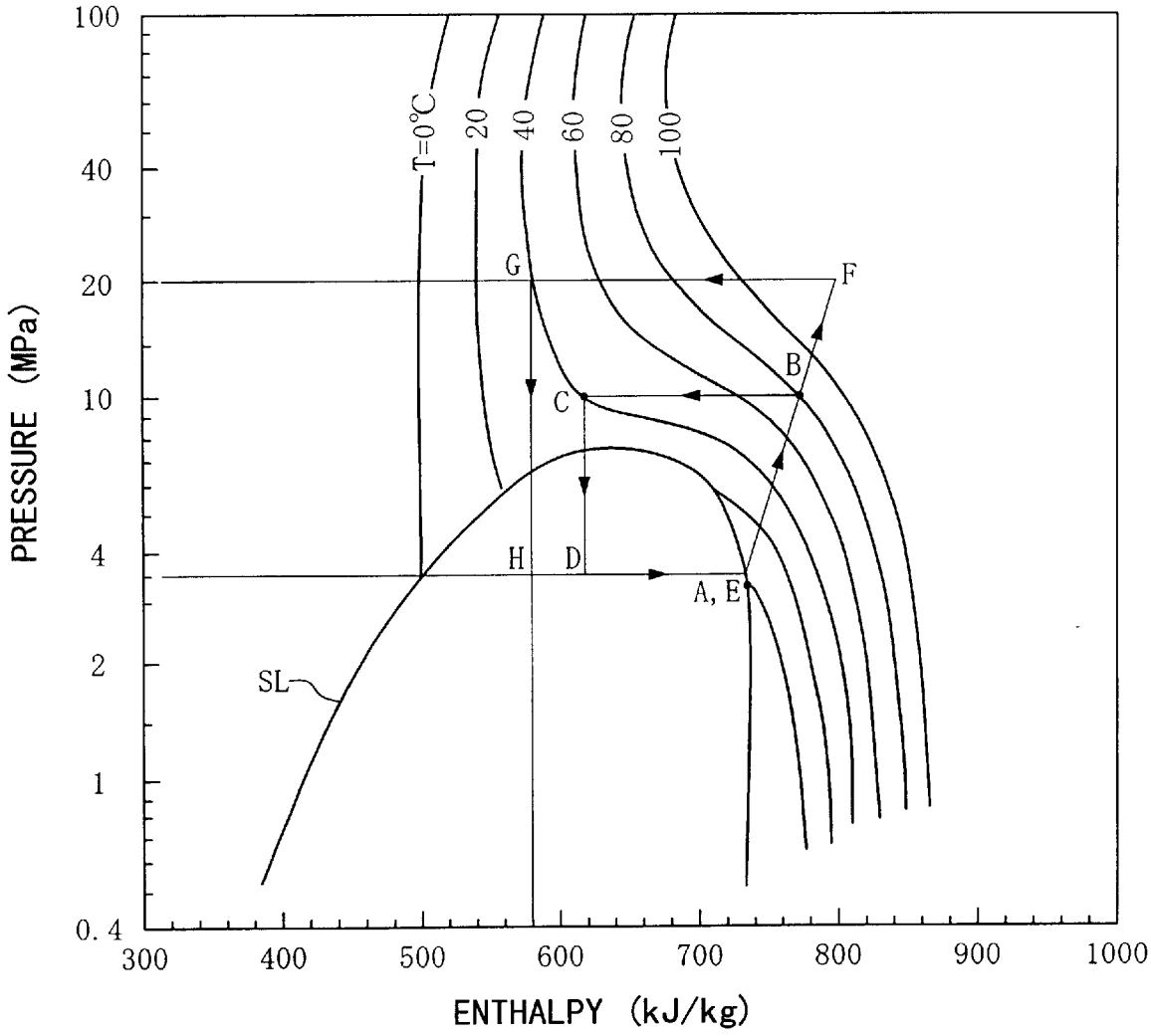
FIG. 5 is a Mollier chart for $CO_2$.

First, the $CO_2$ cycle (structure) including the scroll compressor according to the present invention will be explained with reference to FIG. 4. The $CO_2$ cycle S in FIG. 4 is applied, for example, to the air conditioner of a vehicle. Reference numeral 1 indicates a scroll compressor for compressing $CO_2$ in the gas phase. This scroll compressor 1 receives driving force from a driving power supply (not shown) such as an engine. Reference numeral 1*a* indicates a gas cooler for heat-exchanging $CO_2$ compressed in the scroll compressor 1 and outside air (or the like), so as to cool $CO_2$. Reference numeral 1*b* indicates a pressure control valve for controlling the pressure at the outlet side of the gas cooler 1*a* according to the $CO_2$ temperature at the outlet side of the gas cooler 1*a*. $CO_2$ is decompressed by the pressure control valve 1*b* and restrictor 1*c*, and $CO_2$ enters into the gas-liquid phase (i.e., in the two-phase state). Reference numeral 1*d* indicates an evaporator (i.e., heat absorber) as an air cooling means in the cabin of the vehicle. When $CO_2$ in the gas-liquid two-phase state is vaporized (or evaporated) in the evaporator 1*d*, $CO_2$ takes heat (corresponding to the latent heat of $CO_2$) from the air in the cabin so that the air in the cabin is cooled. Reference numeral 1*e* indicates an accumulator for temporarily storing $CO_2$ in the gas phase. The scroll compressor 1, gas cooler 1*a*, pressure control valve 1*b*, restrictor 1*c*, evaporator 1*d*, and accumulator 1*e* are connected via piping 1*f* so as to form a closed circuit.

Figure 1:
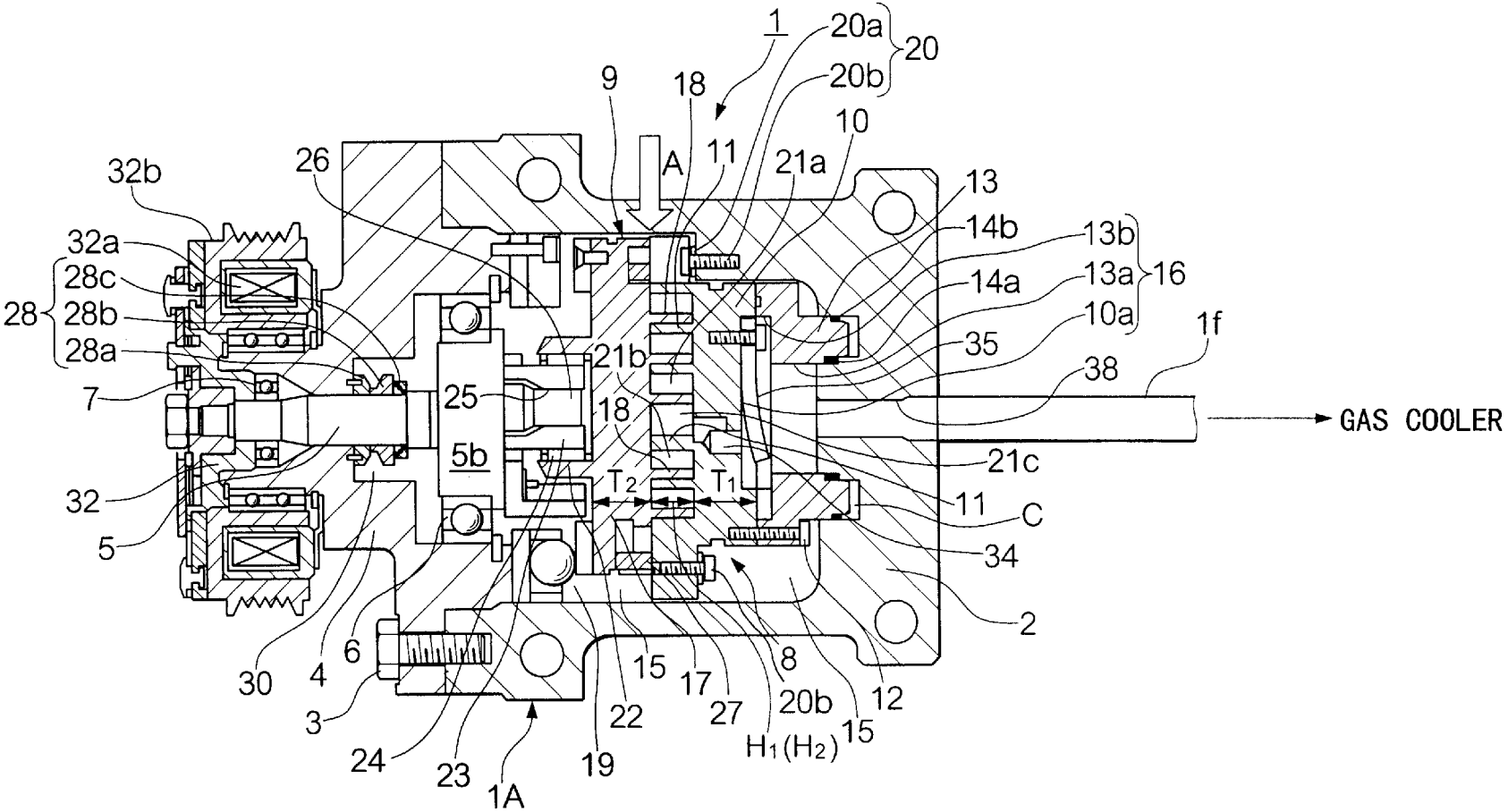
FIG. 1 is a cross-sectional view in the longitudinal direction of an embodiment of the scroll compressor according to the present invention.

An embodiment of the scroll compressor 1 will be explained with reference to FIG. 1.

Housing (or casing) 1 A of scroll compressor 1 includes cup-like main body 2, and front case (i.e., crank case) 4 fastened to the main body 2 via bolt 3. Reference numeral 5 indicates a crank shaft which pierces the front case 4 and is supported via main bearing 6 and sub bearing 7 by the front case 4 in a freely-rotatable form. The rotation of the engine (not shown) of the vehicle is transmitted via a known electromagnetic clutch 32 to the crank shaft 5. Reference numerals 32*a* and 32*b* respectively indicate the coil and pulley of the electromagnetic clutch 32.

In the housing 1A, fixed scroll 8 and revolving scroll 9 are provided. The fixed scroll 8 and revolving scroll 9 are made of, for example, an aluminum-based or cast iron-based material.

The fixed scroll 8 comprises end plate 10 and spiral protrusion (i.e., lap) 11 disposed on a surface of the plate 10, and the surface facing end plate 17 explained later. A ring-shaped back pressure block 13 is detachably attached to the back face of end plate 10 by using a plurality of bolts 12 as fastening means. O rings 14*a* and 14*b* are provided (or embedded) in the inner-peripheral and outer-peripheral faces of the back pressure block 13. These O rings 14*a* and 14*b* closely contact the inner-peripheral face of main body 2 of the casing, and high-pressure chamber (discharge chamber, explained later) 16 is separated from low-pressure chamber 15 (suction chamber) in the main body 2 of the casing. The high-pressure chamber 16 consists of a space surrounded by smaller-diameter face 13*a* of the back pressure block 13, a space surrounded by larger-diameter face 13*b* of the back pressure block 13, this space being formed continuously with the above space surrounded by face 13*a*, and a space surrounded by concave portion 10*a* formed in the back face of the end plate 10 of fixed scroll 8, this space being formed continuously with the above space surrounded by face 13*b*. In the end plate 10 of fixed scroll 8, discharge port 34 (i.e., top clearance) is opened, and discharge valve 35 for opening/closing this discharge port 34 is provided in the concave portion 10*a*.

The revolving scroll 9 comprises end plate 17 and spiral protrusion (i.e., lap) 18 which is disposed on a surface of the plate 17, the surface facing the end plate 10. The shape of the spiral protrusion 18 is substantially the same as that of the spiral protrusion 11 of the fixed scroll 8.

One of the distinctive features of the present embodiment is that thickness $T_1$ of end plate 10 of fixed scroll 8 is larger than 0.9 times as much as height $H_1$ of spiral protrusion 11, and, more specifically, approximately 1.7 times as much as height $H_1$. Similarly, thickness $T_2$ (=$T_1$) of end plate 17 of revolving scroll 9 is larger than 0.9 times as much as height $H_2$ (=$H_1$) of spiral protrusion 18, and, more specifically, approximately 1.7 times as much as height $H_2$.

A ring-shaped plate spring 20*a* is provided between the fixed scroll 8 and the main body 2 of the casing. A plurality of predetermined positions of the plate spring 20*a* are alternately fastened to the fixed scroll 8 and to the main body 2 via bolts 20*b*. According to this structure, the fixed scroll 8 can move only in its axial direction by the (amount of) maximum flexure of plate spring 20*a* in the axial direction (i.e., a floating structure). The above ring-shaped plate springs 20*a* and bolts 20*a* form fixed scroll supporting apparatus 20. Between the portion protruding from the back face of the back pressure block 13 and housing 1A, gap C is provided, so that the back pressure block 13 can move in the axial direction described above. The fixed scroll 8 and the revolving scroll 9 are engaged in a manner such that the axes of these scrolls are eccentrically separated from each other by the radius of revolution (that is, in an eccentric form), and the phases of these scrolls differ from each other by 180° (refer to FIG. 1). In addition, tip seals (not shown), provided and buried at the head surface of spiral protrusion 11, are in close contact with the inner surface (facing the end plate 10) of end plate 17, while tip seals (not shown), provided and buried at the head surface of spiral protrusion 18, are in close contact with the inner surface (facing the end plate 17) of end plate 10. Furthermore, the side faces of the spiral protrusions 11 and 18 contact each other at some positions so that enclosed spaces 21*a* and 21*b* are formed essentially at positions of point symmetry with respect to the center of the spiral. In addition, rotation-preventing ring (i.e., Oldham coupling) 27 for permitting the revolving scroll 9 to revolve, but prohibiting the rotation of the scroll 9 is provided between the fixed scroll 8 and revolving scroll 9.

A boss 22 is provided on (or projects from) a central area of the outer surface of the end plate 17. A freely-rotatable drive bush 23 is inserted in the boss 22 via revolving bearing (or drive bearing) 24 which also functions as a radial bearing. In addition, a freely-rotatable eccentric shaft 26, projecting from the inner-side end of the crank shaft 5, is inserted in through hole 25 provided in the drive bush 23. Furthermore, thrust ball bearing 19 for supporting the revolving scroll 9 is provided between the outer-circumferential edge of the outer surface of end plate 17 and the front case 4.

A known mechanical seal (i.e., shaft seal) 28 used for sealing a shaft is provided around the crank shaft 5, and this mechanical seal 28 comprises seat ring 28*a* fixed to the front case 4, and slave ring 28*b* which rotates together with crank shaft 5. This slave ring 28*b* is forced by forcing member 28*c* towards seat ring 28*a* and closely contacts the seat ring 28*a*, so that the slave ring 28*b* rotationally slides on the seat ring 28*a* in accordance with the rotation of the crank shaft 5.

Figure 2A:
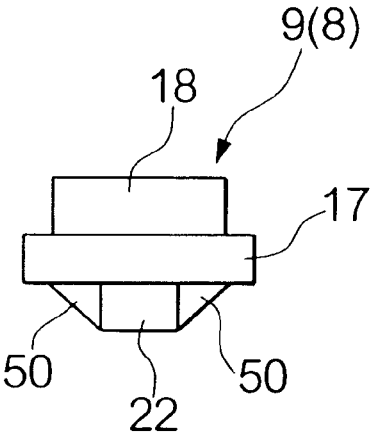
FIGS. 2A and 2B show an example structure of the revolving scroll, where
Figure 2B:
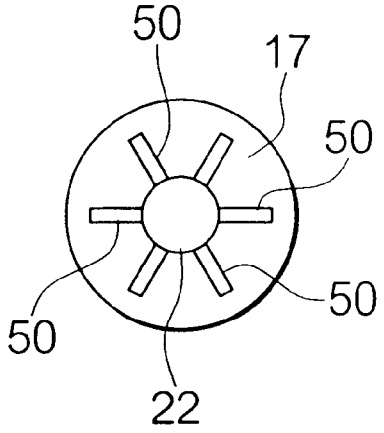
Figure 2C:
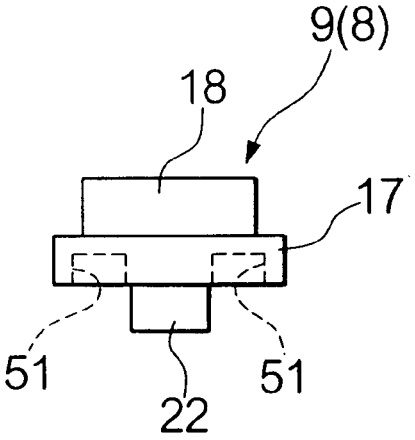
FIGS. 2C and 2D show another example structure of the revolving scroll, where
Figure 2D:
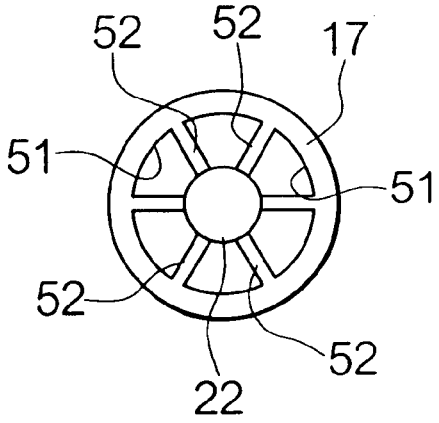

Another distinctive feature of scroll compressor 1 of the present embodiment is that, as shown in FIGS. 2A and 2B, a plurality of (e.g., 6) ribs 50, functioning as reinforcements, are provided in a radial form at the back face side of the end plate 17 of revolving scroll 9. In the back face of the end plate 17, the protruding ribs 50 are provided in a ring-shaped area having a predetermined width around boss 22, where a slide face having a predetermined width (on which ribs 50 are not provided) remains at the outer-peripheral side of the end plate 17. According to the above structure of providing ribs 50 at the revolving scroll 9 side, even if the thickness of the end plate 17 is smaller than the height of the spiral protrusion 18, that is, smaller than an originally defined size, rigidity equivalent to that obtained by the structure having the originally defined size can be obtained. The structure of the ribs is not limited to the above form as shown in FIGS. 2A and 2B, but another structure as shown in FIGS. 2C and 2D is possible, in which a plurality of ribs 52 are also provided in a radial form at the back face side of the end plate 17 of revolving scroll 9. In this case, the ribs are formed by providing a plurality of concave portions 51 in a ring-shaped area having a predetermined width around boss 22, where a slide face having a predetermined width (in which concave portions 51 are not provided) remains at the outer-peripheral side of the end plate 17. That is, the ribs 52 are formed in the end plate 17 in this case. Similarly, ribs functioning as reinforcements are also provided in a radial form at the fixed scroll 8 side.

The operation of the scroll compressor 1 will be explained below.

When the rotation of the vehicle engine is transmitted to the crank shaft 5 by energizing the coil 32*a* of the electromagnetic clutch 32, the revolving scroll 9 is driven by the rotation of the crank shaft 5, transmitted via the revolution driving mechanism consisting of eccentric shaft 26, through hole 25, drive bush 23, revolving bearing 24, and boss 22. The revolving scroll 9 revolves along a circular orbit having a radius of revolution, while rotation of the scroll 9 is prohibited by the rotation-preventing ring 27.

In this way, line-contact portions in the side faces of spiral protrusions 11 and 18 gradually move toward the center of the "swirl", and thereby enclosed spaces (i.e., compression chambers) 21*a* and 21*b* also move toward the center of the swirl while the volume of each chamber is gradually reduced.

Accordingly, the working gas (refer to arrow A), which has flowed into suction chamber 15 through a suction inlet (not shown), enters enclosed space 21*a* from an opening at the ends of the spiral protrusions 11 and 18 and reaches center space 21*c* while the gas is compressed. The compressed gas then passes through discharge port 34 provided in the end plate 10 of the fixed scroll 8, and opens discharge valve 35, so that the gas is discharged into high-pressure chamber 16. The gas is further discharged outside via discharge outlet 38. In this way, according to the revolution of the revolving scroll 9, the fluid introduced from the suction chamber 15 is compressed in the enclosed spaces 21*a* and 21*b*, and this compressed gas is discharged.

When the energizing process for coil 32*a* of electromagnetic clutch 32 is released so as to stop transmission of the rotating force to crank shaft 5, the operation of the scroll compressor 1 is stopped. When the coil 32*a* of electromagnetic clutch 32 is energized again, the scroll compressor 1 is activated again.

In the above-explained structure of the scroll compressor 1, the thickness $T_1$ (=$T_2$) of end plates 10 and 17 of the fixed scroll 8 and revolving scroll 9 is relatively smaller than 0.9 times as much as height $H_1$ (=$H_2$) of the spiral protrusions 11 and 18. Therefore, even in a scroll compressor having a considerably high operating pressure, the end plates 10 and 17 of the fixed scroll 8 and revolving scroll 9 are not easily deformed when the end plates receive a load generated in the compression operation, and thus the sealing ability of compression chamber 20 is not degraded. As a result, the (amount of) discharge is not decreased due to the leakage of the working gas from the compression chamber 20, and the temperature of the discharge gas does not rise due to recompression of the leaked gas, so that the performance of the compressor is improved.

Figure 3:
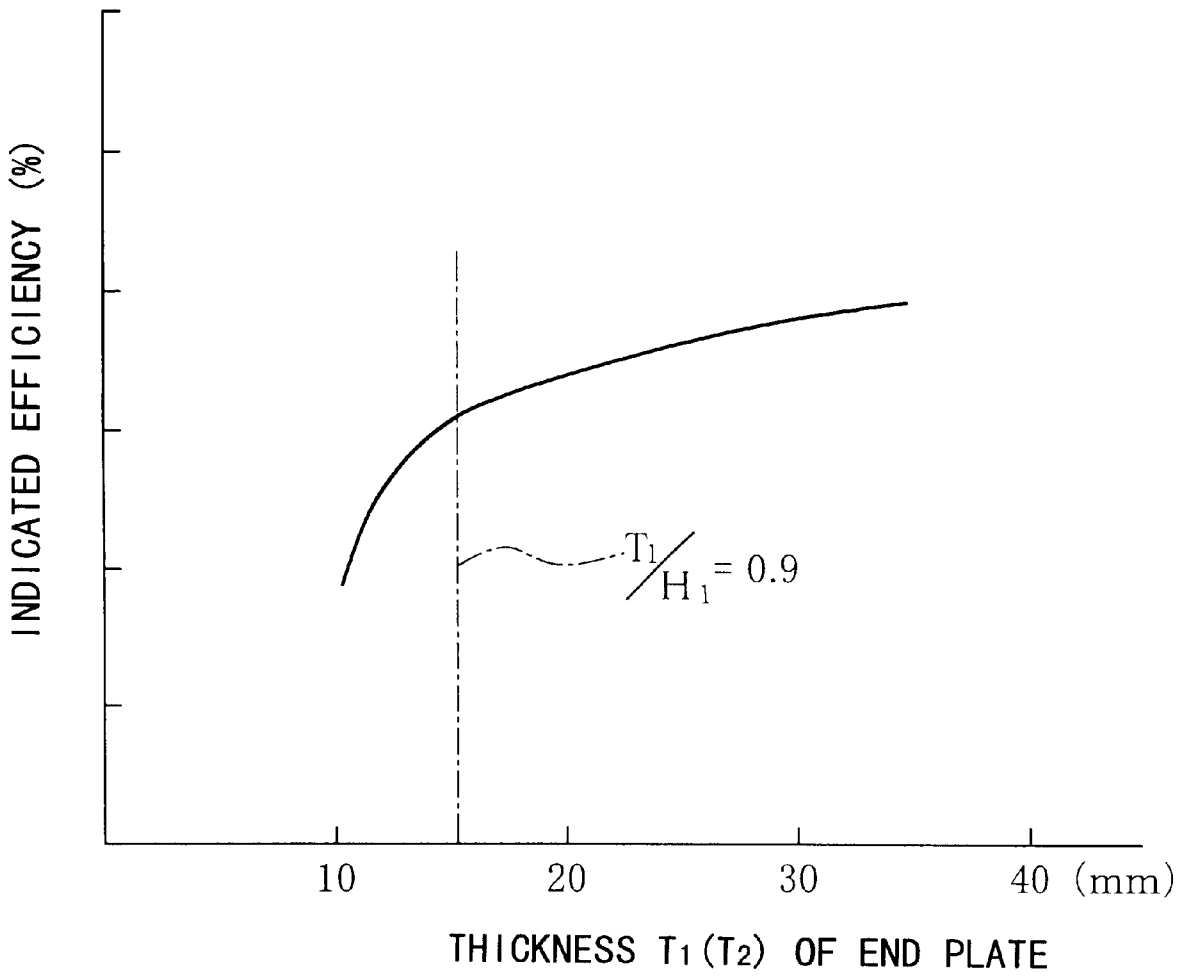
FIG. 3 is a graph showing experimental results which show a relationship between thickness $T_1$ (=$T_2$) of the end plates of the fixed and revolving scrolls and indicated efficiency $\eta_i$.

FIG. 3 is a graph showing experimental results which show a relationship between thickness $T_1$ (=$T_2$) and indicated efficiency $\eta_i$, where efficiency $\eta_i$ is a ratio of theoretical power to the sum of theoretical power and indicated power loss (which means power loss caused by leakage of the working gas). As shown in the graph, if $T_1$ is 0.9 $H_1$, or less, indicated efficiency $\eta_i$, remarkably decreases. Therefore, in the present embodiment, thickness $T_1$, is set to be larger than 0.9 $H_1$, and similarly, thickness $T_2$ is set to be larger than $0.9H_2$.

In particular, a smaller scroll compressor is required for the air conditioner of a vehicle; thus, the height (i.e., thickness) of each end plate of the fixed and revolving scrolls is limited and is preferably $T_1(=T_2)<3H_1(=H_2)$.

In the above explained embodiment, the scroll compressor is applied to the $CO_2$ cycle using $CO_2$ as the working gas; however, the application is not limited to this type, and the compressor according to the present invention can be applied to the vapour-compression refrigerating cycle using a conventional working gas such as Freon.

What is claimed is:

1. A scroll compressor comprising:

a casing;

a fixed scroll provided in the housing and comprising an end plate and a spiral protrusion built on one face of the end plate; and a revolving scroll provided in the casing and comprising an end plate and a spiral protrusion built on one face of the end plate, wherein the spiral protrusions of each scroll are engaged with each other so as to form a spiral compression chamber, wherein:

a working gas introduced in the casing is compressed in the compression chamber and then discharged according to the revolving operation of the revolving scroll; and given thickness $T_1$ of the end plate of the fixed scroll, thickness $T_2$ of the end plate of the revolving scroll, height $H_1$ of the spiral protrusion of the fixed scroll, and height $H_2$ of the spiral protrusion of the revolving scroll, the following condition is satisfied:

$$T_1>0.9H_1$$

$$T_2>0.9H_2.$$

2. A scroll compressor as claimed in claim 1, wherein ribs for reinforcing the fixed scroll and the revolving scroll are respectively provided at the back face side of each scroll.

3. A scroll compressor as claimed in claim 2, wherein in the back face of each end plate, one or more protruding ribs for reinforcing each scroll are provided in a ring-shaped area having a predetermined width, where a slide face having a predetermined width on which no rib is provided remains at the outer-peripheral side of the end plate.

4. A scroll compressor as claimed in claim 2, wherein in the back face of each end plate, one or more ribs are formed by providing a plurality of concave portions in a ring-shaped area having a predetermined width, where a slide face having a predetermined width in which no concave portion is provided remains at the outer-peripheral side of the end plate.

5. A scroll compressor as claimed in claim 1, wherein the fixed scroll and the revolving scroll are made of one of an aluminum-based material and a cast iron-based material.

6. A scroll compressor as claimed in claim 1, wherein the working gas is carbon dioxide.

* * * * *